US011024226B2

(12) United States Patent
Chun

(10) Patent No.: US 11,024,226 B2
(45) Date of Patent: Jun. 1, 2021

(54) PIXEL CIRCUIT, ORGANIC LIGHT EMITTING DISPLAY DEVICE AND DRIVING METHOD FOR THE SAME

(71) Applicant: LG Display Co., Ltd., Seoul (KR)

(72) Inventor: KwangIl Chun, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/703,753

(22) Filed: Dec. 4, 2019

(65) Prior Publication Data

US 2020/0184886 A1 Jun. 11, 2020

(30) Foreign Application Priority Data

Dec. 6, 2018 (KR) ..... 10-2018-0156252

(51) Int. Cl.
*G09G 3/3225* (2016.01)
*G09G 3/3291* (2016.01)

(52) U.S. Cl.
CPC ..... *G09G 3/3225* (2013.01); *G09G 3/3291* (2013.01); *G09G 2320/02* (2013.01); *G09G 2330/021* (2013.01)

(58) Field of Classification Search
CPC ..... G09G 3/3225; G09G 3/3291; G09G 2330/021; G09G 2320/02; G09G 2310/08; G09G 2300/0819; G09G 2300/0861; G09G 2320/045; G09G 2300/0852; G09G 3/3233
See application file for complete search history.

(56) References Cited

U.S. PATENT DOCUMENTS

2010/0013806 A1* 1/2010 Yoo ..... G09G 3/3233 345/204
2017/0337874 A1* 11/2017 Toyomura ..... G09G 3/20

* cited by examiner

*Primary Examiner* — Sahlu Okebato
(74) *Attorney, Agent, or Firm* — Seed IP Law Group LLP

(57) ABSTRACT

The present disclosure relates to a pixel circuit and an organic light emitting display device that include an organic light emitting diode, a first transistor receiving a pixel power source in response to a data signal and supplying a driving current to the organic light emitting diode, and a capacitor holding the data signal supplied to the first transistor, and to a method of driving the pixel circuit and the organic light emitting display device. In the capacitor, after a first voltage corresponding to a threshold voltage of the first transistor is stored, a second voltage resulting from compensating the first voltage relative to mobility of the first transistor is stored, and a value obtained by adding a third voltage corresponding to the data signal to the second voltage in response to the data signal is stored.

18 Claims, 11 Drawing Sheets

PIXEL CIRCUIT, ORGANIC LIGHT EMITTING DISPLAY DEVICE AND DRIVING METHOD FOR THE SAME

CROSS-REFERENCE TO RELATED APPLICATION

This application claims the priority benefit of Korean Patent Application No. 10-2018-0156252, filed on Dec. 6, 2018 in the Korean Intellectual Property Office, the disclosure of which is incorporated herein by reference in its entirety.

BACKGROUND

Technical Field

The present disclosure relates to pixel circuits, organic light emitting display devices and methods of driving the pixel circuits and organic light emitting display devices.

Description of the Related Art

As the information society has developed at a rapid rate, there is an increasing need for display devices employing advanced technologies and more efficient methods. Recently, various types of display devices, such as a liquid crystal display (LCD) device, a plasma display panel (PDP) device, an organic light emitting display device, or the like, have been developed and utilized.

An organic light emitting diode used in the organic light emitting display device of such display devices has a self-emitting property, high luminous efficiency, and a low operating voltage characteristic. Accordingly, the organic light emitting display device has a high contrast ratio and can be implemented as a relatively thin package. Further, the organic light emitting display device has a short response time characteristic without an afterimage, and no restriction to a viewing angle. The organic light emitting display device can be stably operated at a low temperature.

However, the organic light emitting display device includes a plurality of pixels in one display panel, and each pixel includes an organic light emitting diode and a driving transistor for supplying a driving current to the organic light emitting diode. A difference in characteristics of driving transistors can occur in the process of fabricating the organic light emitting display device. That is, a difference in threshold voltages and mobility of driving transistors can occur. As a result, driving currents supplied to the organic light emitting diodes are not constant due to a difference in characteristics; therefore, there is a possibility that desired luminance cannot be represented.

BRIEF SUMMARY

Accordingly, the present disclosure is directed to pixel circuits, organic light emitting display devices and methods of driving the pixel circuits and the organic light emitting display devices that substantially obviate one or more problems due to limitations and disadvantages of the prior art.

The present disclosure provides a pixel circuit and an organic light emitting display device which are capable of improving the quality of a displayed image, and a method of driving the gate driver and the organic light emitting display device.

The present disclosure provides a pixel circuit and an organic light emitting display device which are capable of reducing power consumption, and a method of driving the gate driver and the organic light emitting display device.

In accordance with one aspect of the present disclosure, an organic light emitting display device is provided that includes a display panel including a plurality of pixels, a data driver transferring one or more data signals to the plurality of pixels, a gate driver transferring one or more gate signals to the plurality of pixels, and a timing controller controlling the data driver and the gate driver. Each pixel includes an organic light emitting diode, a first transistor receiving a pixel power source when a data signal is transferred and supplying a driving current to the organic light emitting diode, and a capacitor holding the data signal supplied to the first transistor. In the capacitor, after a first voltage corresponding to a threshold voltage of the first transistor is stored, a second voltage resulted from compensating the first voltage for mobility of the first transistor is stored, and when the data signal is transferred, a value obtained by adding a third voltage corresponding to the data signal to the second voltage is stored.

In accordance with another aspect of the present disclosure, a pixel circuit is provided that includes a first transistor having a gate electrode connected to a first node, a first electrode connected to a second node, and a second electrode connected to a third node; a second transistor having a gate electrode connected to a gate line, a first electrode connected to a data line, and a second electrode connected to the first node; a third transistor having a gate electrode connected to a sensing control signal line, a first electrode connected to an initialization voltage line, and a second electrode connected to the third node; a fourth transistor having a gate electrode connected to a light emitting control signal line, a first electrode connected to a pixel power source, and a second electrode connected to the second node; a fifth transistor having a gate electrode connected to a sampling signal line, a first electrode connected to a reference voltage line, and a second electrode connected to the first node; a capacitor connected between the first and third nodes; and an organic light emitting diode having an anode electrode connected to the third node, and a cathode electrode connected to another power source.

In accordance with further another aspect of the present disclosure, a method is provided for driving an organic light emitting display device that includes an organic light emitting diode, a first transistor supplying a driving current to the organic light emitting diode and a capacitor connected between the gate electrode and source electrode of the first transistor, the method comprising storing, in the capacitor, a first voltage corresponding to a threshold voltage of the first transistor, storing, in the capacitor, a second voltage resulting from compensating the first voltage for mobility of the first transistor, applying a data voltage corresponding to a data signal to the gate electrode of the first transistor, and supplying a driving current to the organic light emitting diode relative to a voltage stored in the capacitor and the data voltage.

In accordance with embodiments of the present disclosure, it is possible to provide a pixel circuit and an organic light emitting display device which are capable of improving the quality of a displayed image, and a method of driving the pixel circuit and the organic light emitting display device.

In accordance with embodiments of the present disclosure, it is possible to provide a pixel circuit and an organic light emitting display device which are capable of reducing power consumption, and a method of driving the pixel circuit and the organic light emitting display device.

Additional features and advantages of the disclosure will be set forth in the description which follows and in part will be apparent from the description, or may be learned by practice of the disclosure. The objectives and other advantages of the disclosure will be realized and attained by the structure particularly pointed out in the written description and claims hereof as well as the appended drawings.

DETAILED DESCRIPTION

Figure 1:
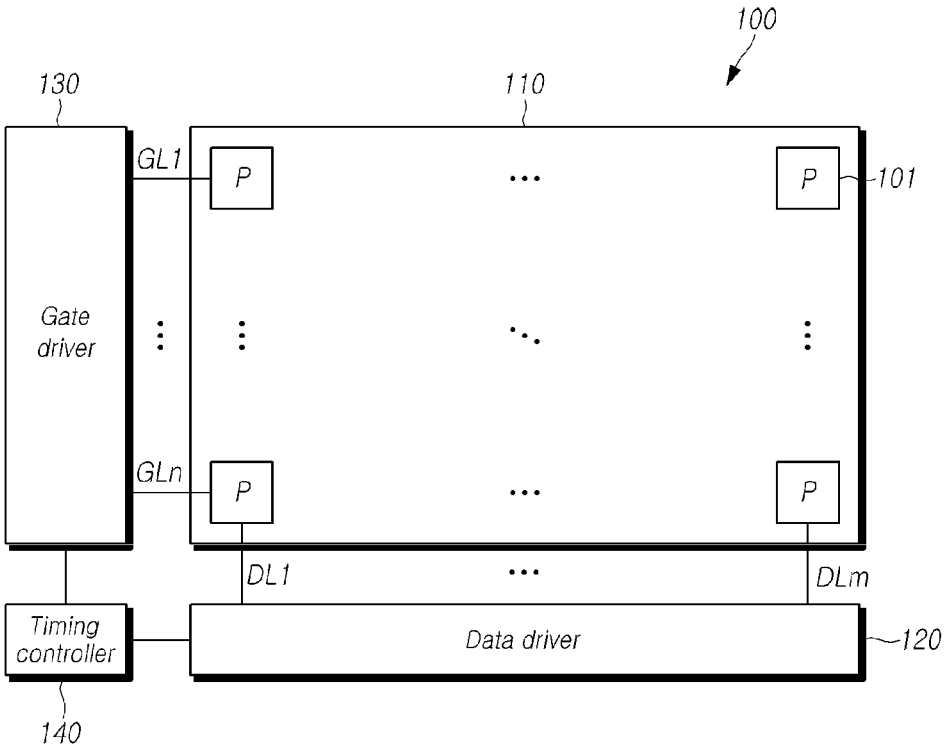
FIG. 1 is a diagram schematically illustrating an organic light emitting display device according to embodiments of the present disclosure.

The advantages and features of the present disclosure and methods of achieving the same will be apparent by referring to aspects of the present disclosure as described below in detail in conjunction with the accompanying drawings. However, the present disclosure is not limited to the aspects set forth below, but may be implemented in various different forms. The following aspects are provided only to completely disclose the present disclosure and inform those skilled in the art of the scope of the present disclosure, and the present disclosure is defined only by the scope of the appended claims.

In addition, the shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the present specification. Further, in the following description of the present disclosure, detailed description of well-known functions and configurations incorporated herein will be omitted when it is determined that the description may make the subject matter in some embodiments of the present disclosure rather unclear. The terms such as "including", "having", "containing", "comprising of" used herein are generally intended to allow other components to be added unless the terms are used with the term "only". As used herein, singular forms are intended to include plural forms unless the context clearly indicates otherwise.

In interpreting any elements or features of the embodiments of the present disclosure, it should be considered that any dimensions and relative sizes of layers, areas and regions include a tolerance or error range even when a specific description is not conducted.

Terms, such as first, second, A, B, (A), or (B) may be used herein to describe elements of the disclosure. Each of the terms is not used to define essence, order, sequence, or number of an element, but is used merely to distinguish the corresponding element from another element. When it is mentioned that an element is "connected" or "coupled" to another element, it should be interpreted that another element may be "interposed" between the elements or the elements may be "connected" or "coupled" to each other via another element as well as that one element is directly connected or coupled to another element. Spatially relative terms, such as, "on", "over", "above", "below", "under", "beneath", "lower", "upper", "near", "close", "adjacent", and the like, may be used herein to describe one element or feature's relationship to another element(s) or feature(s) as illustrated in the figures, and it should be interpreted that one or more elements may be further "interposed" between the elements unless the terms such as 'directly', "only" are used.

Any elements or features of the embodiments of the present disclosure are not limited to a specific meaning of the terms described above. The terms as used herein are merely for the purpose of describing examples and are not intended to limit the present disclosure. Although the terms "first", "second", and the like are used for describing various elements, or features, these elements are not confined by these terms. These terms are merely used for distinguishing one element from other elements. Therefore, a first element to be mentioned below may be a second element in a technical concept of the present disclosure.

The elements or features of various exemplary embodiments of the present disclosure can be partially or entirely bonded to or combined with each other and can be interlocked and operated in technically various ways as can be fully understood by a person having ordinary skill in the art, and the various exemplary embodiments can be carried out independently of or in association with each other.

Hereinafter, exemplary embodiments of the present disclosure will be described in detail with reference to the accompanying drawings.

FIG. 1 is a diagram schematically illustrating a structure of a display device according to embodiments of the present disclosure.

Referring to FIG. 1, the display device 100 can comprise a display panel 110, a data driver 120, a gate driver 130, and a timing controller 140.

The display panel 110 can comprise a plurality of data lines (DL1, . . . , DLm) arranged in a first direction and a plurality of gate lines (GL1, . . . , GLn) arranged in a second direction. FIG. 1 shows that the plurality of data lines (DL1, . . . , DLm) and the plurality of gate lines (GL1, . . . , GLn) intersect each other, but embodiments of the present disclosure are not limited thereto. Lines arranged in the display panel 110 are not limited to the gate lines (DL1, . . . , GLn) and the data lines (GL1, . . . , DLm).

The display panel 110 can comprise a plurality of pixels 101 arranged to be corresponded to areas in which the plurality of gate lines (GL1, . . . , GLn) and the plurality of data lines (DL1, . . . , DLm) intersect each other. The plurality of pixels comprises a plurality of pixel rows in the horizontal and a plurality of pixel columns in the vertical, which are arranged in a matrix. Pixels arranged in one pixel row can be connected to an identical gate line. However, embodiments of the present disclosure are not limited thereto, and other arrangements are possible.

The data driver 120 can apply one or more data signals to the plurality of data lines (DL1, . . . , DLm). The data signal may correspond to a gray scale, and a voltage level of the data signal may be determined depending on a corresponding gray scale. A voltage of the data signal can sometimes be referred to as a data voltage. It is noted that a single data driver 120 is illustrated in FIG. 1, but embodiments of the present disclosure are not limited thereto. For example, two or more data drivers may be employed according to the size or resolution of the display panel 110. In addition, the data driver 120 may be implemented as an integrated circuit.

The gate driver 130 can apply one or more gate signals to the plurality of gate lines (GL1, . . . , DLm). Pixels 101 corresponding to the plurality of gate lines (GL1, . . . , GLn) to which a gate signal is applied can received a data signal. It is noted that a single gate driver 130 is illustrated in FIG. 1, but embodiments of the present disclosure are not limited thereto. For example, two or more gate drivers may be employed according to the size or resolution of the display panel 110. Further, the gate driver 130 can comprise two gate drivers disposed on both sides of the display panel 110. One of the gate drivers can be connected to one or more odd numbered gate lines of the plurality of gate lines (GL1, . . . , GLn) and the other can be connected to one or more even numbered gate lines of the plurality of gate lines (GL1, . . . , GLn). However, embodiments of the present disclosure are not limited thereto, and other configurations are possible.

The gate driver 130 can output a light emitting control signal, a sensing control signal and a sampling signal other than the gate signal. However, embodiments of the present disclosure are not limited thereto, and other signals or voltages may be outputted. The light emitting control signal, the sensing control signal and the sampling signal can be delivered to the pixel 101 through one or more separate lines arranged in the display panel 110. The gate driver 130 may be implemented as an integrated circuit.

The timing controller 140 can control the data driver 120 and the gate driver 130. The timing controller 140 can transfer an image signal corresponding to a data signal to the data driver 120. The image signal may be a digital signal. The timing controller 140 can correct the image signal and then transfer the corrected image signal to the data driver 120. The timing controller 140 can control a timing at which a reference voltage is transferred to the pixel 101. The reference voltage can comprise a first reference voltage and a second reference voltage with a higher level than the first reference voltage. Compensation for a threshold voltage and mobility of a driving transistor can be performed relative to the reference voltage.

Figure 2:
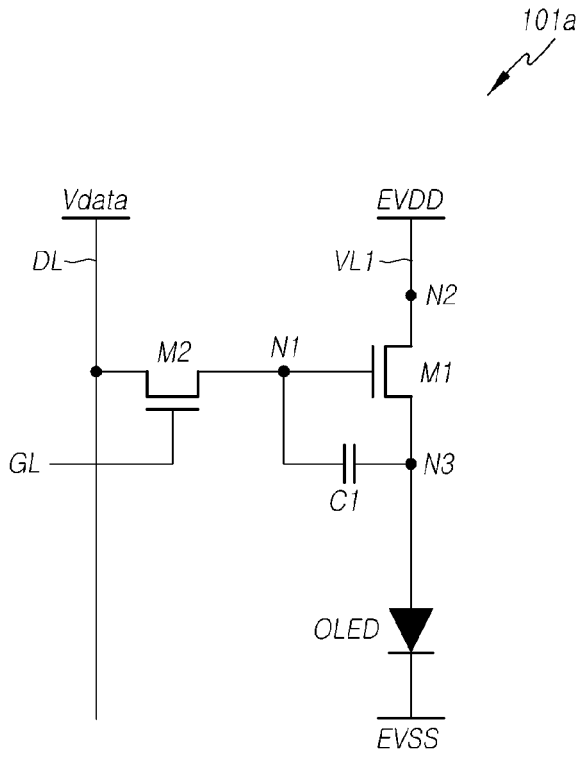
FIG. 2 is a circuit diagram illustrating a first embodiment of a pixel illustrated in FIG. 1 according to embodiments of the present disclosure.

FIG. 2 is a circuit diagram illustrating a first embodiment of the pixel illustrated in FIG. 1 according to embodiments of the present disclosure.

FIG. 2 shows the first embodiment of the pixel shown in FIG. 1.

Referring to FIG. 2, the pixel 101*a* can comprise an organic light emitting diode (OLED) and a pixel circuit for driving the OLED. The pixel circuit can comprise a first transistor M1, a second transistor M2, and a capacitor C1.

The gate electrode of the first transistor M1 can be connected to a first node N1, and a first electrode thereof can be connected to a second node N2 connected to a pixel power source line VL1 to which a first pixel power source EVDD is delivered, and a second electrode thereof can be connected to a third node N3. The first transistor M1 enables a current to flow across the third node N3 when a voltage is delivered to the first node N1. The first electrode and the source electrode of the first transistor M1 may be a drain electrode and a source electrode, respectively. However, embodiments of the present disclosure are not limited thereto, and the first electrode and the source electrode may be the source electrode and the drain electrode, respectively. In some embodiments, the first transistor M1 can be referred to as a driving transistor.

A current flowing across the third node N3 may correspond to Equation 1 as follows.

$$Id=k(V_{GS}-Vth)^2 \quad \text{[Equation 1]}$$

Here, the Id denotes an amount of current flowing across the third node N3, the k denotes electron mobility of the first transistor M1, the $V_{GS}$ denotes a difference in voltages between the gate electrode and the source electrode of the first transistor, and the Vth denotes a threshold voltage of the first transistor M1.

The gate electrode of the second transistor M2 can be connected to a gate line GL, and first and second electrodes thereof can be connected to a data line DL and the first node N1, respectively. Accordingly, the second transistor M2 enables a data voltage Vdata corresponding to the data signal to be transferred to the first node N1 in response to the gate signal delivered through the gate line GL. The first electrode and the source electrode of the second transistor M2 may be a drain electrode and a source electrode, respectively. However, embodiments of the present disclosure are not limited thereto, and the first electrode and the source electrode of the second transistor M2 may be the source electrode and the drain electrode, respectively.

The first electrode and the second electrode of the capacitor C1 can be connected to the first node N1 and the third node N3, respectively. The capacitor C1 can constantly hold voltages in the gate electrode and the source electrode of the first transistor M1.

The anode electrode and the cathode electrode of the OLED can be connected to the third node N3 and a second pixel power source EVSS, respectively. The second pixel power source EVSS may have a lower voltage level than the first pixel power source EVDD. For example, the second pixel power source EVSS may be grounded. However, embodiments of the present disclosure are not limited thereto, and the second pixel power source EVSS may be set to other voltage levels. The second pixel power source EVSS may be supplied through a low power source line. The second pixel power source EVSS can be commonly supplied to at least two organic light emitting diodes (OLED). When a current flows from the anode electrode to the cathode electrode, the OLED can emit light depending on the amount of the current (e.g., the amount of driving current flowing through the OLED). The OLED can emit light of any one of red, green, blue, and white. However, embodiments of the present disclosure are not limited thereto, and the OLED may emit light of other colors.

As shown in the Equation 1, there is a problem that the amount of a driving current flowing from the first electrode to the second electrode of the first transistor M1 depends on at least one of threshold voltages and electron mobilities of the first transistor M1. Accordingly, in order for a driving current in response to a data signal to flow constantly, compensating for the threshold voltage and electron mobility of the first transistor M1 may be performed.

Figure 3A:
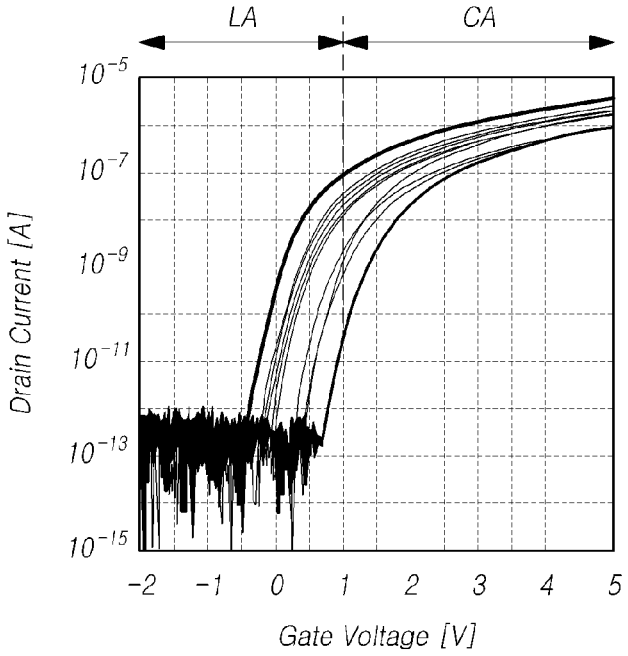
FIG. 3A is a graph representing a difference in driving currents in the pixel illustrated in FIG. 2.
Figure 3B:
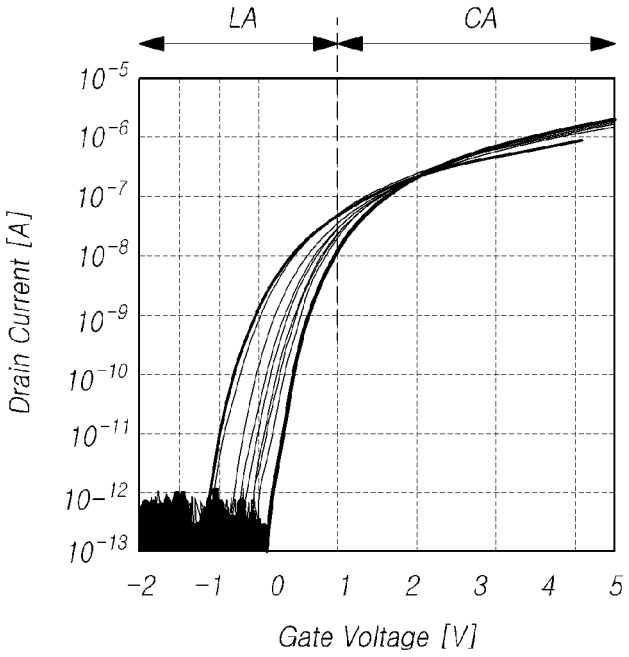
FIG. 3B is a graph representing a difference in currents of driving transistors after threshold voltages thereof have been compensated in the pixel illustrated in FIG. 2.

FIG. 3A is a graph representing a difference in driving currents in the pixel illustrated in FIG. 2, and FIG. 3B is a graph representing a difference in currents of driving transistors after compensation for threshold voltages has been performed in the pixel illustrated in FIG. 2.

Referring to FIGS. 3A and 3B, the first transistor M1 shown in FIG. 2 can be operated in a saturation region CA where a change in an amount of current is relatively small and a linear region LA where a change in an amount of current is relatively large, in response to a voltage applied to the gate electrode. Further, in order to allow a current flowing from the first electrode to the second electrode of the first transistor M1 to flow constantly, operating the first transistor M1 at the saturation region CA may be desired. When compensation for the threshold voltage of the first transistor M1 is not performed, as shown in FIG. 3A, it can be seen that a difference in driving currents is large in both the saturation region CA and the linear region LA. Accordingly, when compensation for the threshold voltage of the first transistor M1 is not performed, there is a possibility that luminance uniformity in the display panel 110 can be lowered. When compensation for the threshold voltage of the first transistor M1 is performed, as shown in FIG. 3B, although a difference in currents in the linear region LA is relatively high, since a difference in currents in the saturation region CA is relatively small, luminance uniformity can be improved by operating the first transistor M1 in the saturation region CA. However, since a difference in currents is still present in the saturation region CA; therefore, there is a possibility that the luminance may not be uniform. In particular, when the first transistor M1 comprises oxide semiconductor, there is a possibility that the difference in currents may be larger. The oxide semiconductor can comprise indium-gallium-zinc oxide (InGaZnO), or indium-tin-oxide (ITO). However, embodiments of the present disclosure are not limited thereto, and the oxide semiconductor may comprise other materials.

Using the oxide semiconductor is advantageous to fabricate a large-sized display panel. However, as described above, since luminance can become non-uniform due to a large difference in currents when the oxide semiconductor is used, it is necessary to compensate for the electron mobility, as well as the threshold voltage. Accordingly, compensating for both the threshold voltage and the electron mobility of the first transistor M1 is beneficial.

Figure 4:
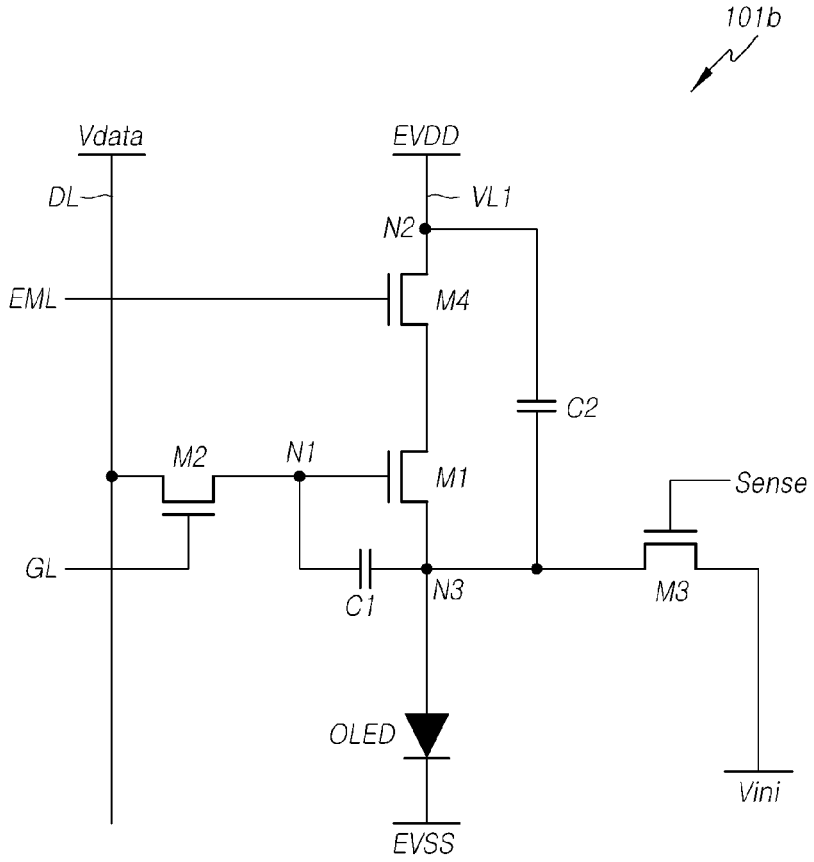
FIG. 4 is a circuit diagram illustrating a second embodiment of the pixel illustrated in FIG. 1 according to embodiments of the present disclosure.

FIG. 4 is a circuit diagram illustrating a second embodiment of the pixel illustrated in FIG. 1 according to embodiments of the present disclosure.

Referring to FIG. 4, the pixel 101*b* can comprise a first transistor M1, a second transistor M2, a third transistor M3, a fourth transistor M4, a first capacitor C1, a second capacitor C2 and an OLED.

The gate electrode, a first electrode and a second electrode of the first transistor M1 can be connected to a first node N1, a second node N2 and a third node N3, respectively. The gate electrode, a first electrode and a second electrode of the second transistor M2 can be connected to a gate line GL, a data line DL and the first node N1, respectively. The gate electrode, a first electrode and a second electrode of the third transistor M3 can be connected to a sensing control signal line Sense, an initialization voltage Vini and the third node N3, respectively. The gate electrode, a first electrode and a second electrode of the fourth transistor M4 can be connected to a light emitting control signal line EML, a first pixel power source EVDD and the third node N3, respectively. A first electrode and a second electrode of the first capacitor C1 can be connected to the first node N1 and the third node N3, respectively. A first electrode and a second electrode of the second capacitor C2 can be connected to the second node N2 and the third node N3, respectively.

Here, the first electrode and the source electrode of respective transistors may be a drain electrode and a source electrode, respectively. However, embodiments of the present disclosure are not limited thereto, and the first electrode and the source electrode of respective transistors may be the source electrode and the drain electrode, respectively. A gate signal can be transferred to the gate line GL, a sensing control signal can be transferred to the sensing control signal line Sense, and a light emitting control signal can be transferred to the light emitting control signal line EML. Further, either a data voltage Vdata corresponding to a data signal or a reference voltage can be transferred to the data line DL. Further, at least one of the first, second, third and fourth transistors M1, M2, M3 and M4 may be a transistor comprising oxide semiconductor.

Figure 5:
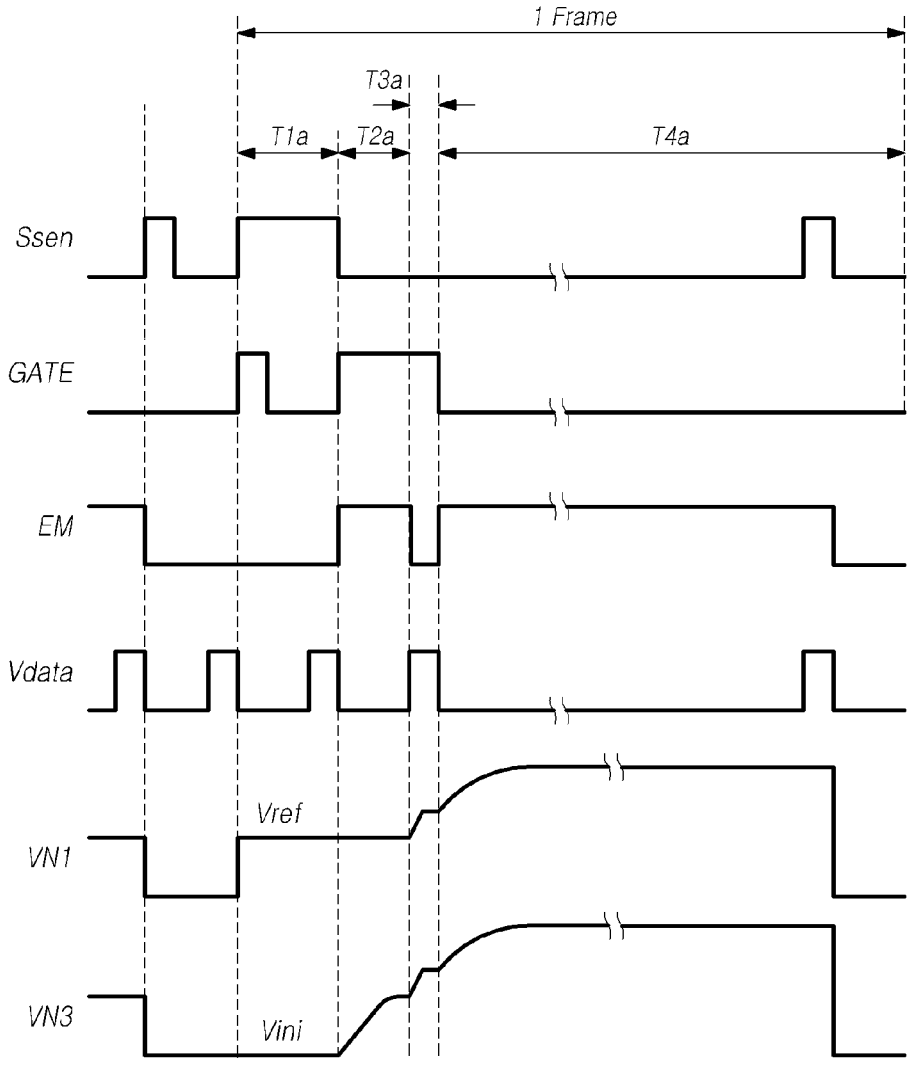
FIG. 5 is a timing diagram illustrating operation of the pixel illustrated in FIG. 4.

FIG. 5 is a timing diagram illustrating operation of the pixel illustrated in FIG. 4.

Referring to FIG. 5, a sensing control signal Ssen with a high level can be transferred to the pixel 101 at a first interval T1*a*. The sensing control signal Ssen can remain in a high state at the first interval T1*a*. A gate signal GATE with a high level can be transferred in the first interval T1*a*. The gate signal GATE can remain in the high state at a part of the first interval T1*a*. A data voltage Vdata corresponding to a data signal is not transferred in an interval in which the gate signal GATE with the high level is transferred, of the first interval T1*a*, but the data voltage Vdata can be transferred in an end interval in which the gate signal GATE with a low level is transferred, of the first interval T1*a*. Further, a reference voltage Vref can be delivered through the data line DL during an interval in which the data voltage Vdata is not transferred, of the first interval T1*a*. A light emitting control signal EM with a low level can be transferred in the first interval T1*a*. The reference voltage Vref may be lower than a threshold voltage of the OLED.

More specifically, in the first interval T1*a*, the second transistor M2 can become an on-state in response to the gate signal GATE, and the third transistor M3 can become the on-state in response to the sensing control signal Ssen. On the contrary, the fourth transistor M4 can remain in an off-state by the light emitting control signal EM. When the fourth transistor M4 is in the off-state, a current for driving the first transistor M1 does not occur as the first pixel power source EVDD is not transferred to the first transistor M1. The second transistor M2 is in the on-state by the gate signal GATE. The reference voltage Vref instead of the data voltage Vdata can be transferred to the data line DL. Accordingly, the reference voltage Vref is transferred to the first node N1; a level of a voltage VN1 at the first node N1 may have a level of the reference voltage Vref. The third transistor M3 is in the on-state by the sensing control signal Ssen; thus, the initialization voltage Vini is transferred to the third node N3. As a result, the first capacitor C1 can be initialized by the reference voltage Vref and the initialization voltage Vini. Accordingly, a level of a voltage VN3 at the third node N3 can have a level of the initialization voltage Vini. After transferring the reference voltage Vref to the first node N1, the second transistor M2 can become the off-state in response to the gate signal GATE.

In a second interval T2*a*, the sensing control signal Ssen with a low level can be transferred and the gate signal GATE with the high level can be transferred. Further, the light emitting control signal EM can become the high state in the second interval T2*a*. In the second interval T2*a*, the gate signal GATE can become the high state again and the second transistor M2 can become the on-state. In addition, in the second interval T2*a*, the third transistor M3 can become the off-state by the sensing control signal Sense. In addition, in the second interval T2*a*, the fourth transistor M4 can become the on-state by the light emitting control signal Em. When the fourth transistor M4 becomes the on-state, a level of the voltage VN3 at the third node N3 rises as current flows from the first electrode to the second electrode of the first transistor M1 by the first pixel power source EVDD transferred to the second node N2. The level of voltage VN3 at the third node N3 rises up to a voltage having a difference corresponding the threshold voltage of the first transistor M1 from the level of the voltage VN1 at the first node N1. Accordingly, the threshold voltage of the first transistor M1 is stored in the capacitor C1 by the level of the voltage VN1 at the first node N1 and the level of the voltage VN3 at the third node N3.

In a third interval T3*a*, the gate signal GATE remains in the high state. Further, a data voltage Vdata corresponding to a data signal can be transferred to through the data line DL. Accordingly, the data voltage Vdata can be transferred to the first node N1. The data voltage Vdata may have a higher level than the reference voltage Vref. When the data voltage Vdata is transferred to the first node N1, the voltage level VN1 at the first node N1 rises up to the data voltage Vdata. In the third interval T3*a*, since a voltage stored in the first capacitor C1 disposed between the first node N1 and the third node N3 is held, as a level of the voltage VN1 at the first node N1 rises, a level of the voltage VN3 at the third node N3 rises as well, and may be a sum of the data voltage and the threshold voltage. A slope at which a level of the voltage VN3 at the third node N3 rises can be determined according to the flowing of a current corresponding to the electron mobility. Accordingly, in the third interval T3*a*, a voltage corresponding to the data voltage Vdata is written in the capacitor C1, and compensation for the electron mobility can be performed by the current corresponding to the electron mobility. As a result, a level of the voltage VN1 at the first node N1 may be a sum of the data voltage Vdata and a voltage corresponding to the electron mobility compensation. A level of the voltage VN3 at the third node N3 may be a sum of the data voltage Vdata, the voltage corresponding to the electron mobility compensation and the threshold voltage of the first transistor M1 by the first capacitor C1.

The gate signal GATE and the sensing control signal Ssen can be in a low state in a fourth interval T4*a*. However, the light emitting control signal EM with the high level can be transferred. The second transistor M2 and the third transistor M3 can become the off-state by the gate signal GATE and the sensing control signal Ssen, respectively, and the fourth transistor M4 can become the on-state by the light emitting control signal EM. Accordingly, the first pixel power source EVDD can be transferred to the first electrode of the first transistor M1. At this time, since a current flowing across the third node N3 is determined relative to a difference between a level of the voltage VN1 at the first node N1 corresponding to the gate electrode of the first transistor M1 and a level of the voltage VN3 at the third node N3 corresponding to the second electrode of the first transistor M1, and the flowing of the current by the difference between the voltage level VN1 at the first node N1 and the voltage level VN3 at the third node N3 corresponding to the second electrode of the first transistor M1 can be performed relative to the threshold voltage and the electron mobility of the first transistor M1, the current relative to the threshold voltage and the electron mobility of the first transistor M1 can flow across the OLED; thus, luminance uniformity can be improved. The current flows across the third node N3, and a level of the voltage VN3 at the third node N3 can rise because the current cannot flow across the OLED up to a time at which a level of the voltage VN3 at the third node N3 become lower than the threshold voltage of the OLED, A level of the voltage VN1 at the first node N1 can rise relative to the voltage level VN3 at the third node N3.

Figure 6:
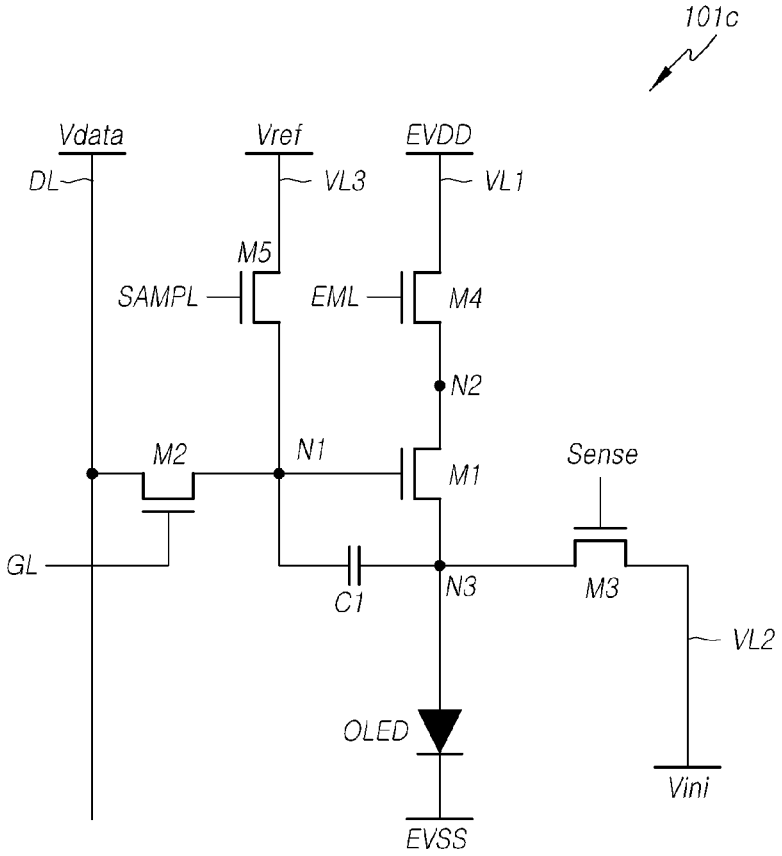
FIG. 6 is a circuit diagram illustrating a third embodiment of the pixel illustrated in FIG. 1 according to embodiments of the present disclosure.

FIG. 6 is a circuit diagram illustrating a third embodiment of the pixel illustrated in FIG. 1 according to embodiments of the present disclosure.

Referring to FIG. 6, the pixel 101*c* can comprise a first transistor M1, a second transistor M2, a third transistor M3, a fourth transistor M4, a fifth transistor M5, a second capacitor C1 and an OLED.

The gate electrode, a first electrode and a second electrode of the first transistor M1 can be connected to a first node N1, a second node N2 and a third node N3, respectively. The gate electrode, a first electrode and a second electrode of the second transistor M2 can be connected to a gate line GL, a data line DL and the first node N1, respectively. The gate electrode, a first electrode and a second electrode of the third transistor M3 can be connected to a sensing control signal line Sense, an initialization voltage line VL2 and the third node N3, respectively. The gate electrode, a first electrode and a second electrode of the fourth transistor M4 can be connected to a light emitting control signal line EML, a pixel power source EVDD and the second node N2, respectively. The gate electrode, a first electrode and a second electrode of the fifth transistor M5 can be connected to a sampling signal line SAMPL, a reference voltage line VL3 and the first node N1, respectively. The capacitor C1 can be connected between the first node N1 and the third node N3. The anode electrode and the cathode electrode of the OLED can be connected to the third node N3 and another pixel power source EVSS, respectively. Further, at least one of the first, second, third, fourth and fifth transistors M1, M2, M3, M4 and M5 may be a transistor comprising oxide semiconductor.

Figure 7:
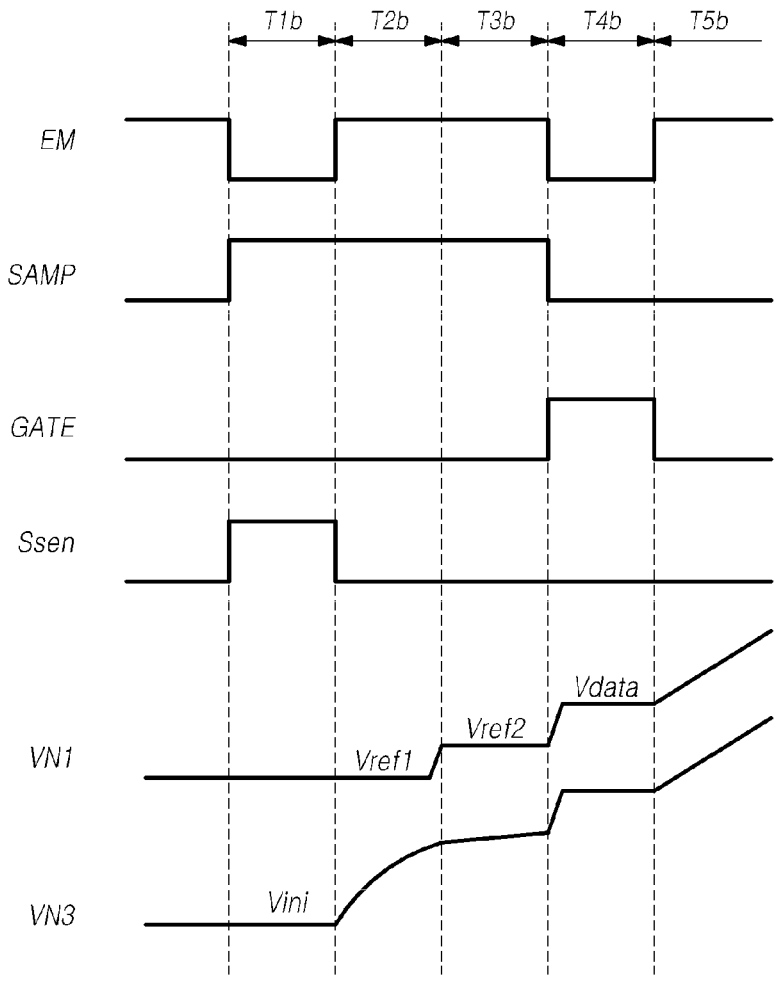
FIG. 7 is a timing diagram illustrating operation of the pixel illustrated in FIG. 6.

FIG. 7 is a timing diagram illustrating operation of the pixel illustrated in FIG. 6.

Referring to FIG. 7, a sampling signal SAMP with a high level and a sensing control signal Ssen with a high level are supplied in a first interval T1*b*, the sampling signal SAMP with the high level and a light emitting control signal EM with a high level are supplied in a second interval T2*b*, the sampling signal SAMP with the high level and the light emitting control signal EM with the high level are supplied in a third interval T3*b*, a gate signal GATE with a high level is supplied in a fourth interval T4*b*, and the light emitting control signal EM with the high level are supplied in a fifth interval T5*b*.

More specifically, the sampling signal SAMP with the high level and the sensing control signal Ssen with the high level can be transferred to the pixel 101*c* in the first interval T1*b*. Further, the gate signal GATE with a low level and the light emitting control signal EM with a low level can be transferred to the pixel 101*c*. The third transistor M3 and the fifth transistor M5 can become the on-state in response to the sensing control signal Ssen and the sampling signal SAMP, respectively. The second transistor M2 and the fourth transistor M4 can become the off-state in response to the gate signal GATE and the light emitting control signal EM, respectively. Accordingly, an initialization voltage Vini supplied through the initialization voltage line VL2 can be transferred to the third node N3 through the third transistor M3, and a first reference voltage Vref1 supplied through the reference voltage line VL3 can be transferred to the first node N1 through the fifth transistor M5. The capacitor C1 can be initialized by the initialization voltage Vini and the first reference voltage Vref1. The first reference voltage Vref1 may be lower than a threshold voltage of the OLED.

In a second interval T2*b*, the sampling signal SAMP can remain in the high state. Further, the light emitting control signal EM with the high level can be transferred. However, the gate signal GATE with the low level and the sensing control signal Ssen with a low level can be transferred. Accordingly, the second transistor M2 and the third transistor M3 can become the off-state, and the fourth transistor M4 and the fifth transistor M5 can become the on-state. The first reference voltage Vref1 can be maintained on the reference voltage line VL3. When the fourth transistor M4 becomes the on-state, a first pixel power source EVDD can be transferred to the second node N2, and when the fifth transistor M5 becomes the on-state, the reference voltage Vref1 can be transferred to the first node N1. When the first pixel power source EVDD is transferred to the second node N2, a level of the voltage VN3 at the third node N3 rises as current flows from the first electrode to the second electrode, of the first transistor M1. At this time, the level of voltage VN3 at the third node N3 rises up to a voltage having a difference corresponding the threshold voltage of the first transistor M1 from a level of the voltage VN1 at the first node N1. Accordingly, the threshold voltage of the first transistor M1 is stored in the capacitor C1 by the level of the voltage VN1 at the first node N1 and the level of the voltage VN3 at the third node N3.

In a third interval T3*b*, the sampling signal SAMP and the light emitting control signal EM can remain in the high state. Further, the gate signal GATE and the sensing control signal Ssen can remain in the low state. Accordingly, the second transistor M2 and the third transistor M3 can remain in the off-state, and the fourth transistor M4 and the fifth transistor M5 can remain in the on-state. At this time, a second reference voltage Vref2 can be transferred to the reference voltage line VL3. A level of the second reference voltage Vref2 may be higher than that of the first reference voltage Vref1. Further, the level of the second reference voltage Vref2 may be lower than that of the threshold voltage of the OLED. Since the level of the second reference voltage Vref2 is greater than that of the first reference voltage Vref1, a current further flows across the third node N3, and a level of the voltage VN3 at the third node N3 rises. Since the flowing of the current across the third node N3 corresponds to electron mobility, a level of the voltage VN3 at the third node N3 can be compensated for the electron mobility. Accordingly, a voltage corresponding to the electron mobility can be stored in the capacitor C1.

The gate signal GATE with a high level can be supplied in a fourth interval T4*b*. However, the light emitting control signal EM with the low level, the sampling signal SAMP with a low level, the sensing control signal Ssen with the low level are supplied in the fourth interval T4*b*. Accordingly, the second transistor M2 become the on-state, but the first transistor M1, the third transistor M3, the fourth transistor M4 and the fifth transistor M5 become the off-state. When the second transistor M2 becomes the on-state, a data voltage Vdata applied to the data line DL is transferred to the first node N1. The data voltage Vdata may be higher than either the first reference voltage Vref1 or the second reference voltage Vref2. When the data voltage Vdata is transferred to the first node N1, a level of the voltage VN1 at the first node N1 reaches the level of the data voltage Vdata. At this time, since the voltage difference between the first node N1 and the third node N3 is maintained by the capacitor C1, a level of the voltage VN3 at the third node N3 rises as a level of the voltage VN1 at the first node VN1 rises from the second reference voltage Vref2 to the data voltage Vdata. Accordingly, the level of the voltage VN3 at the third node N3 corresponds to the data voltage Vdata, the threshold voltage and the voltage corresponding to the electron mobility.

At this time, after a voltage corresponding to the threshold voltage and the electron mobility is stored in the capacitor C1, the data voltage Vdata is transferred to the first node N1; therefore, a level of the voltage VN1 at the first node N1 maintains the data voltage. Accordingly, since the level of the voltage VN1 applied to the first node N1 is lower than that of the voltage VN1 at the first node N1 in the pixel 101*b* as shown in FIG. 4, it is possible to reduce power consumption further in comparison with an organic light emitting display device comprising a display panel including the pixel 101*b* shown in FIG. 4.

The light emitting control signal EM with the high level can be transferred in a fifth interval T5*b*. However, the sampling signal SAMP with the low level, the gate signal GATE with the low level and the sensing control signal Ssen with the low level can be transferred in the fifth interval T5*b*. Accordingly, the fourth transistor M4 can become the on-state, but the second transistor M2, the third transistor M3 and the fifth transistor M5 can become the off-state. The first pixel power source EVDD is supplied to the second electrode of the first transistor M1 by the fourth transistor M4; therefore, the first transistor M1 can supply a driving current corresponding to the voltage stored at the capacitor C1 to the OLED. At this time, a level of the voltage VN3 at the third node N3 rises up to a time at which the level of the voltage VN3 is higher than a threshold voltage of the OLED, and as a result, a level of the voltage VN1 at the first node VN1 rises as well by the capacitor C1. Since the OLED can emit light by a driving current corresponding to a difference in levels of the voltage VN1 at the first node N1 and the voltage VN3 at the third node N3, the OLED can emit light relative to the threshold voltage and a voltage resulted from the compensation for the electron mobility. As a result, luminance uniformity can be improved.

Here, the sensing control signal Ssen has been described as a separate signal from the gate signal GATE, but embodiments of the present disclosure are not limited thereto. For example, each of the plurality of pixel rows of the display panel 110 in shown in FIG. 1 receives sequentially a gate signal GATE, and the sensing control signal Ssen may be a gate signal of one of pixel rows received gate signals GATE at an earlier time than a pixel row received a gate signal GATE. For example, when a pixel row received a gate signal GATE is an n-th pixel row, the sensing control signal Ssen may be a gate signal GATE transferred to an (n−3)th pixel row. That is, the gate signal GATE transferred to an (n−3)th pixel row may be a sensing control signal of n-th pixel row. As a result, the gate driver 130 shown in FIG. 1 may be simplified.

Figure 8:
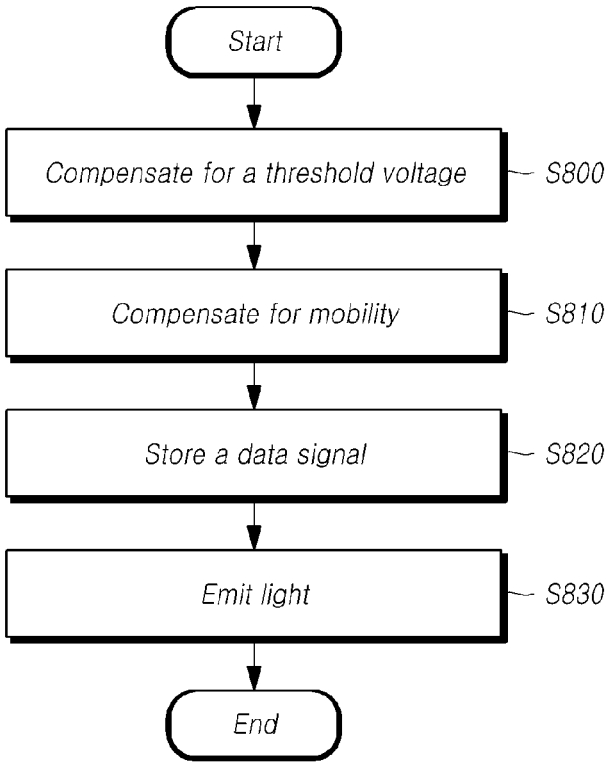
FIG. 8 is a flow diagram illustrating a method of driving the organic light emitting display device according to embodiments of the present disclosure.

FIG. 8 is a flow diagram illustrating a method of driving the organic light emitting display device according to embodiments of the present disclosure.

Referring to FIG. 8, the organic light emitting display device can comprise an organic light emitting display device, a first transistor supplying a driving current to the organic light emitting diode, and a capacitor connected between the gate electrode and the source electrode of the first transistor. In accordance with embodiments of the present disclosure, a method of driving the organic light emitting display device comprises compensating for the threshold voltage of the first transistor, at step S900. The compensation for the threshold voltage of the first transistor may be to store a first voltage corresponding to the threshold voltage of the first transistor in the capacitor. The threshold voltage may be stored in the capacitor by a current flowing relative to a first reference voltage when the first reference voltage is applied to the gate electrode of the first transistor.

Further, compensation for the mobility of the first transistor can be performed, at step S910. The compensation for the mobility can be performed by compensating the flowing of a driving current flowing through the first transistor. When the compensation for the mobility and the threshold voltage of the first transistor are performed, the uniformity of luminance can be obtained. In particular, when the first transistor comprises oxide semiconductor, it is possible to enable the driving current to flow constantly by compensating for the threshold voltage and the mobility. The compensation for the mobility can be performed by causing a level of the voltage stored at the capacitor to rise relative to a current flowing as a second reference voltage with a higher level than the first reference voltage is applied to the gate electrode of the first transistor. The first reference voltage and the second reference voltage may have a lower level than the threshold voltage of the organic light emitting diode.

Further, a data signal can be stored at each pixel of the display panel of the organic light emitting display device, at step S920. A data voltage corresponding to the data signal applied to a data line is applied to the gate electrode of the first transistor; therefore, the data signal can be stored at each pixel. The data voltage may have a higher level than the second reference voltage. Since the data voltage is applied after compensation for the threshold voltage and the mobility have been performed, it is unnecessary for a difference in voltage of respective gray scales to be large; thus, a level of data voltages representing from 0 to 255 gray scales can be lowered. As a result, it is possible to reduce the power consumption of the organic light emitting display device. Electrical connection between the pixel power source and the first transistor can be blocked in order to preventing the driving current from flowing across the organic light emitting diode even when the data voltage is applied. Since a voltage corresponding to the threshold voltage and the mobility are stored at the capacitor, compensation for the threshold voltage and the mobility can be performed.

Further, it is possible to enable the organic light emitting diode to emit light, at step S930. It is possible to enable the driving current to be supplied to the organic light emitting diode relative to the threshold voltage and a data voltage resulted from compensate for the mobility by allowing the pixel power source to be connected to the first transistor.

Figure 9:
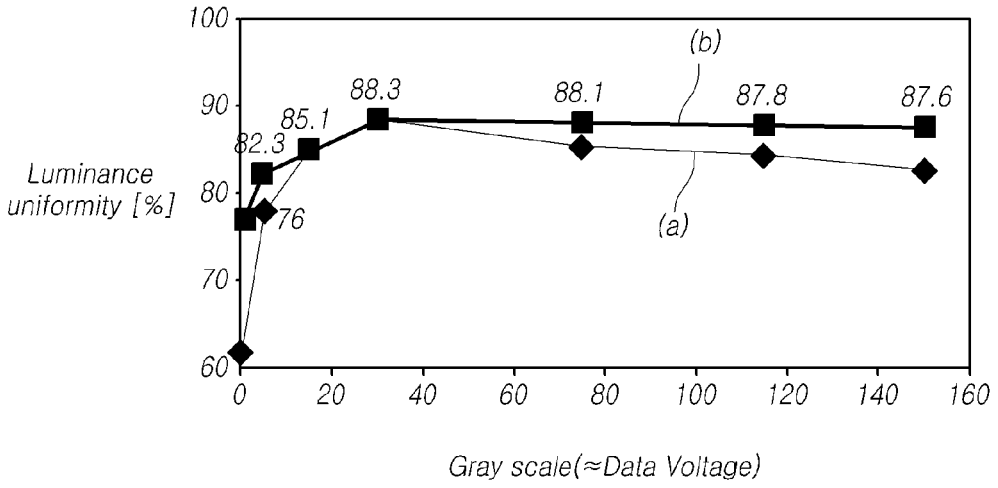
FIG. 9 is a graph representing a result of measurements on a difference in luminance uniformity for respective gray scales of the organic light emitting display device according to embodiments of the present disclosure.
Figure 10:
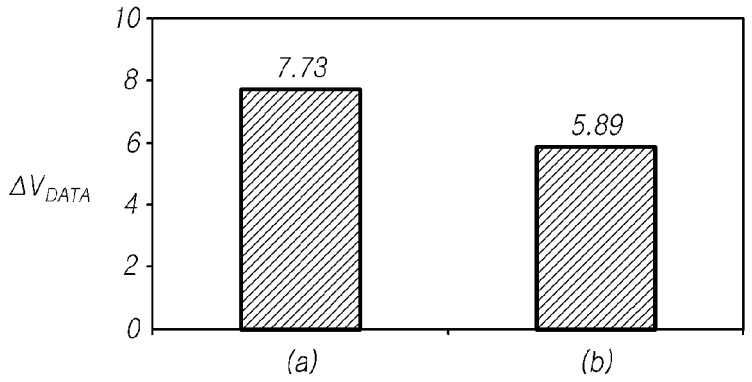
FIG. 10 is a graph representing a result obtained by measuring a difference in voltages of gray scales of the organic light emitting display device according to embodiments of the present disclosure.

FIG. 9 is a graph representing a result of measurements on a difference in luminance uniformity for respective gray scales of the organic light emitting display device according to embodiments of the present disclosure. FIG. 10 is a graph representing a result obtained by measuring a difference in voltages of gray scales of the organic light emitting display device according to embodiments of the present disclosure.

Referring to FIGS. 9 and 10, a display panel with a size of 55 inches and a resolution of ultra-high definition (UHD) has been used for the measurement. Further, a display panel capable of representing from 0 to 255 gray scales has been used.

In FIG. 9, (a) represents a difference of luminance uniformity in respective gray scales in a display panel in which the pixel 101*b* shown in FIG. 4 is employed, and (b) represents a difference of luminance uniformity in respective gray scales in a display panel in which the pixel 101*c* shown in FIG. 6 is employed. As shown in FIG. 9, it can be seen that writing data to a pixel after current compensation for the mobility has been performed has a less difference in luminance uniformity than implementing the current compensation for the mobility and the data writing simultaneously in all gray scales. Accordingly, it can be seen that in driving of a pixel, compensating current for the mobility separately from writing data is more advantageous to reduce power consumption and improve the quality of displayed images.

Further, in FIG. 10, (a) shows gray scale voltages for representing from 0 to 255 gray scales in a display panel in which the pixel 101*b* shown in FIG. 4 is employed, and (b) shows gray scale voltages for representing from 0 to 255 gray scales in a display panel in which the pixel 101*c* shown in FIG. 6 is employed. As shown in (a), the display panel employing the pixel 101*b* shown in FIG. 4 can output a data voltage corresponding to a gray scale using a gray scale voltage with the voltage level of about 7.73V, and as shown in (b), the display panel employing the pixel 101*c* shown in FIG. 6 can output a data voltage corresponding to a gray scale using a gray scale voltage with the voltage level of about 5.89V. That is, since the gray scale voltage can be reduced by about 24%, it can be seen that power consumption of the organic light emitting display device can be reduced.

The features, structures, configurations, and effects described in the present disclosure are included in at least one embodiment but are not necessarily limited to a particular embodiment. A person skilled in the art can apply the features, structures, configurations, and effects illustrated in the particular embodiment embodiments to one or more other additional embodiment embodiments by combining or modifying such features, structures, configurations, and effects. It should be understood that all such combinations and modifications are included within the scope of the present disclosure. Although the exemplary embodiments have been described for illustrative purposes, a person skilled in the art will appreciate that various modifications and applications are possible without departing from the essential characteristics of the present disclosure. For example, the specific components of the exemplary embodiments may be variously modified. The scope of protection of the present disclosure should be construed based on the following claims, and all technical ideas within the scope of equivalents thereof should be construed as being included within the scope of the present disclosure.

The various embodiments described above can be combined to provide further embodiments. Further changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light emitting display device comprising:

a display panel in which a plurality of pixels is arranged;

a data driver transferring a data signal to at least one pixel of the plurality of pixels;

a gate driver transferring a gate signal to the at least one pixel; and a timing controller controlling the data driver and the gate driver, wherein the at least one pixel comprises: an organic light emitting diode;

a first transistor having a first electrode and a second electrode, the first transistor receiving a pixel power source via the first electrode when the data signal is transferred and supplying a driving current to the organic light emitting diode via the second electrode, wherein the first transistor supplies the driving current to the organic light emitting diode based on a threshold voltage and an electron mobility of the first transistor;

a capacitor connected to the first transistor and the organic light emitting diodes;

wherein the capacitor holds the data signal supplied to the first transistor, wherein after a first voltage corresponding to the threshold voltage of the first transistor has been stored in the capacitor, a second voltage resulted from compensating the first voltage for the electron mobility of the first transistor is stored in the capacitor, and when the data signal is transferred, a value obtained by adding a third voltage corresponding to the data signal to the second voltage is stored in the capacitor, a second transistor supplying the data signal to the first transistor;

a third transistor transferring an initialization voltage for initializing the capacitor;

a fourth transistor having a first electrode connected to the pixel power source and a second electrode directly connected to the first electrode of the first transistor, and supplying the pixel power source to the first transistor; and a fifth transistor controlled by a sampling signal enabling the first voltage to be stored at the capacitor by supplying a first reference voltage to the first transistor and enabling the second voltage to be stored at the capacitor by supplying a second reference voltage to the first transistor.

2. The organic light emitting display device according to claim 1, wherein a gate electrode, the first electrode and the second electrode of the first transistor are connected to a first node, a second node and a third node, respectively, and an anode electrode and a cathode electrode of the capacitor are connected to the third node and a second power source, respectively, wherein the second transistor has a gate electrode connected to a gate line, a first electrode connected to a data line, and a second electrode connected to the first node;

the third transistor has a gate electrode connected to a sensing control signal line, a first electrode connected to an initialization voltage line, and a second electrode connected to the third node;

the fourth transistor has a gate electrode connected to a light emitting control signal line; and the fifth transistor has a gate electrode connected to a sampling control signal line, a first electrode connected to a reference voltage line, and a second electrode connected to the first node.

3. The organic light emitting display device according to claim 2, wherein the gate driver outputs the gate signal transferred to the gate line, a light emitting control signal transferred to the light emitting control signal line, a sensing control signal transferred to the sensing control signal line, and the sampling signal transferred to the sampling control signal line.

4. The organic light emitting display device according to claim 3, wherein the sampling signal with a high level and the sensing control signal with a high level are supplied in a first interval, the sampling signal with the high level and the light emitting control signal with a high level are supplied in a second interval, the sampling signal with the high level and the light emitting control signal with the high level are supplied in a third interval, the gate signal with a high level is supplied in a fourth interval, and the light emitting control signal with the high level are supplied in a fifth interval.

5. The organic light emitting display device according to claim 4, wherein the first reference voltage is transferred to the reference voltage line in the second interval, and the second reference voltage with a higher level than the first reference voltage is transferred to the reference voltage line in the third interval.

6. The organic light emitting display device according to claim 3, wherein the sensing control signal is transferred to the at least one pixel at an earlier time than a gate signal transferred to an n-th pixel row of the plurality of pixels.

7. The organic light emitting display device according to claim 1, wherein the first transistor comprises an oxide semiconductor.

8. A pixel circuit comprising: a first transistor having a gate electrode connected to a first node, a first electrode connected to a second node, and a second electrode connected to a third node;

a second transistor having a gate electrode connected to a gate line, a first electrode connected to a data line, and a second electrode connected to the first node;

a third transistor having a gate electrode connected to a sensing control signal line, a first electrode connected to an initialization voltage line, and a second electrode connected to the third node;

a fourth transistor having a gate electrode connected to a light emitting control signal line, a first electrode connected to a pixel power source, and a second electrode directly connected to the first electrode of the first transistor connected to the second node;

a fifth transistor having a gate electrode connected to a sampling signal line that is different from a gate line through which a gate signal is transferred, a first electrode connected to a reference voltage line that is different from the data line through which a data signal is transferred, and a second electrode connected to, the first node;

a capacitor connected between the first node and the third node; and an organic light emitting diode connected to the third node.

9. The pixel circuit according to claim 8, wherein a sampling signal with a high level and a sensing control signal with a high level are supplied to the sampling signal line and the sensing control signal line respectively in a first interval, the sampling signal with the high level and a light emitting control signal with a high level are supplied to the sampling signal line and the light emitting control signal line respectively in a second interval, the sampling signal with the high level and the light emitting control signal with the high level are supplied to the sampling signal line and the light emitting control signal line respectively in a third interval, the gate signal with a high level is supplied to the gate line in a fourth interval, and the light emitting control signal with the high level are supplied to the light emitting control signal line in a fifth interval.

10. The pixel circuit according to claim 9, wherein a first reference voltage is transferred to the reference voltage line in the second interval, and a second reference voltage with a higher level than the first reference voltage is transferred to the reference voltage line in the third interval.

11. The pixel circuit according to claim 9, wherein the sensing control signal is a gate signal transferred at an earlier time than a gate signal transferred to an n-th pixel row of a plurality of pixels.

12. The pixel circuit according to claim 8, wherein at least one of the first, second, third, fourth and fifth transistors comprises an oxide semiconductor.

13. A method of driving an organic light emitting display device comprising an organic light emitting diode, a first transistor receiving a pixel power source via a first electrode and suppling a driving current to the organic light emitting diode via a second electrode, a capacitor connected between a gate electrode and a source electrode of the first transistor, a second transistor supplying a data signal to the first transistor, a third transistor transferring an initialization voltage for initializing the capacitor, and a fourth transistor having a first electrode connected to the pixel power source and a second electrode directly connected to the first electrode of the first transistor, and supplying the pixel power source to the first transistor, and the method comprising;

storing a first voltage corresponding to a threshold voltage of the first transistor in the capacitor;

storing, at the capacitor, a second voltage resulting from compensating the first voltage for an electron mobility of the first transistor;

applying a data voltage corresponding to the data signal to the gate electrode of the first transistor; and supplying the driving current to the organic light emitting diode relative to a voltage stored at the capacitor and the data voltage.

14. The method according to claim 13, further comprising initializing the capacitor before the storing the first voltage corresponding to the threshold voltage.

15. The method according to claim 13, wherein when the storing of the first voltage is performed, a first reference voltage is transferred to the gate electrode of the first transistor, and when the storing of the second voltage is performed, a second reference voltage with a higher level than the first reference voltage is transferred to the gate electrode of the first transistor.

16. The method according to claim 14, wherein the initializing of the capacitor is performed such that an n-th pixel row is initialized when the data signal is written to an (n−3)th pixel row.

17. The organic light emitting display device according to claim 1, wherein the fourth transistor has a gate electrode connected to a light emitting control signal line, the first electrode connected to a first node, and the second electrode connected to a second node, wherein the first node is connected to the pixel power source and the second node is connected to the first transistor; and the third transistor has a gate electrode connected to a sensing control signal line, a first electrode connected to an initialization voltage line, and a second electrode connected to a third node, wherein the third node is connected to the capacitor, the organic light emitting diode, and the first transistor;

wherein the at least one pixel further comprises a second capacitor connected between the first node and the fourth third node.

18. The organic light emitting display device according to claim 17, wherein the gate driver outputs the gate signal transferred to the gate line, a light emitting control signal transferred to the light emitting control signal line, and a sensing control signal transferred to the sensing control signal line.

* * * * *